US010287773B2

(12) United States Patent
Taleb

(10) Patent No.: US 10,287,773 B2
(45) Date of Patent: May 14, 2019

(54) FORMWORK

(71) Applicant: Steadiform Holdings Pty Ltd, Pacific Paradise (AU)

(72) Inventor: Elias Joseph Taleb, Monash (AU)

(73) Assignee: STEADIFORM HOLDINGS PTY LTD., Pacific Paradise (AU)

( * ) Notice: Subject to any disclaimer, the term of this patent is extended or adjusted under 35 U.S.C. 154(b) by 16 days.

(21) Appl. No.: 15/530,260

(22) PCT Filed: Jun. 15, 2015

(86) PCT No.: PCT/AU2015/050329
§ 371 (c)(1),
(2) Date: Dec. 16, 2016

(87) PCT Pub. No.: WO2015/192179
PCT Pub. Date: Dec. 23, 2015

(65) Prior Publication Data

US 2018/0135299 A1 May 17, 2018

(30) Foreign Application Priority Data

Jun. 16, 2014 (AU) ..... 2014902278

(51) Int. Cl.
*E04B 1/12* (2006.01)
*E04B 2/86* (2006.01)
*E04B 1/61* (2006.01)

(52) U.S. Cl.
CPC ..... *E04B 2/8629* (2013.01); *E04B 1/12* (2013.01); *E04B 1/6125* (2013.01);
(Continued)

(58) Field of Classification Search
CPC ..... E04B 2002/867; E04B 2002/8676; E04B 2/8641; E04B 2/8629; E04B 2/8652;
(Continued)

(56) References Cited

U.S. PATENT DOCUMENTS 2,495,862 A * 1/1950 Osborn ..... E04B 1/10 52/578
5,311,718 A * 5/1994 Trousilek ..... E04B 2/8629 52/421
(Continued)

FOREIGN PATENT DOCUMENTS

CN 1136336 A 11/1996
WO 96/06242 A1 2/1996
(Continued)

OTHER PUBLICATIONS

Corresponding International Application PCT/AU2015/050329, International Search Report and Written Opinion dated Sep. 29, 2015.
(Continued)

*Primary Examiner* — Robert Canfield
*Assistant Examiner* — Matthew J Gitlin
(74) *Attorney, Agent, or Firm* — Cooper Legal Group LLC

(57) ABSTRACT

A building formwork module for use in a modular formwork system, the module comprising a first wall spaced away from a second wall, the first and second walls being connected by at least one web extending between the first and second walls, the first and second walls and said at least one web defining a channel extending over at least a part of a longitudinal length of the module, the channel adapted to accommodate fill material during use, the web further comprising at least two apertures spaced apart across the web in between the first and second walls such that during use one or more transverse reinforcing members can be positioned in between reinforcing members received in the spaced apart apertures thereby limiting movement of the transverse reinforcing member there-between during use.

12 Claims, 13 Drawing Sheets

(52) U.S. Cl.
CPC ..... *E04B 2/8641* (2013.01); *E04B 2/8652* (2013.01); *E04B 2002/867* (2013.01); *E04B 2002/8676* (2013.01)

(58) Field of Classification Search
CPC ..... E04B 2/8635; E04B 2/86; E04B 2/8617; E04B 1/12; E04B 1/6137; E04B 1/6125; E04B 1/6179
USPC ..... 52/439, 309.17, 426, 275, 284, 309.12, 52/429, 563, 588.1, 282.1, 586.2, 604, 52/592.1, 742.14, 309.15; 249/47, 191, 249/192, 213, 216
See application file for complete search history.

(56) References Cited

U.S. PATENT DOCUMENTS 5,410,855 A * 5/1995 Clausen ..... B21C 23/145 52/271
5,448,865 A * 9/1995 Palmersten ..... E04B 1/6129 52/309.9
5,465,545 A 11/1995 Trousilek
5,729,944 A * 3/1998 De Zen ..... E04B 1/12 264/154
6,212,845 B1 * 4/2001 De Zen ..... E04B 1/12 52/144
6,247,280 B1 * 6/2001 Grinshpun ..... E04B 2/8635 52/309.12
7,703,248 B2 * 4/2010 Dincel ..... E04B 2/8629 264/209.1
8,322,115 B2 12/2012 Foell et al.
8,677,713 B1 * 3/2014 Sheehy ..... E04O 2/20 52/284
9,206,614 B2 * 12/2015 Richardson ..... E04B 2/8635
9,441,365 B2 * 9/2016 Richardson ..... E04B 2/8652
9,850,658 B2 * 12/2017 Alcala Ordaz ..... E04B 2/8635
2004/0050007 A1 * 3/2004 Curatolo ..... E04F 15/10 52/592.1
2005/0053429 A1 * 3/2005 Davidsaver ..... E02B 3/06 405/284
2006/0005497 A1 1/2006 Foell et al.
2009/0064619 A1 3/2009 Bowerman
2010/0212241 A1 * 8/2010 Holroyd ..... E04B 1/12 52/309.4
2015/0275531 A1 * 10/2015 Alcala Ordaz ..... E04B 2/8658 249/189
2017/0175407 A1 * 6/2017 Richardson ..... E04G 17/001

FOREIGN PATENT DOCUMENTS

WO 2013/117892 A1 8/2013
WO WO2014042502 A1 * 3/2014 ..... E04B 2/86

OTHER PUBLICATIONS

Singapore Search Report cited in Singapore Application No. 1120161069V dated Feb. 23, 2018, 3 pgs.

* cited by examiner

FORMWORK

TECHNICAL FIELD

The present invention relates to formwork for construction. In particular, the present invention relates to formwork panels for use in the construction of buildings.

BACKGROUND ART

In construction, formwork is used to create a temporary or permanent mould into which concrete or a similar material is poured. Formwork is typically fabricated from timber boards or from metal frames having metal or timber boards attached thereto.

In general, formwork is made to measure for the specific location in which it is to be used. Thus, the location in which the formwork is to be used must be carefully measured to ensure that the formwork that is transported to site is the desired size and shape for the application in which it is to be used. A failure to correctly measure the formwork results in delays in construction while new formwork is prepared.

In addition, traditional formwork is relatively heavy and bulky, meaning that its installation is time-consuming and expensive, often requiring equipment such as a crane and a significant number of personnel to assist in the correct installation of the formwork.

In light of the foregoing, there would be an advantage if it were possible to provide formwork that was relatively inexpensive to make, relatively simple to install and allowed for the rapid installation of formwork on a construction site.

It will be clearly understood that, if a prior art publication is referred to herein, this reference does not constitute an admission that the publication forms part of the common general knowledge in the art in Australia or in any other country.

SUMMARY OF INVENTION

The present invention is directed to a formwork panel, which may at least partially overcome at least one of the abovementioned disadvantages or provide the consumer with a useful or commercial choice.

With the foregoing in view, the present invention in one aspect, resides in a building formwork module for use in a modular formwork system, the module comprising a first wall spaced away from a second wall, the first and second walls being connected by at least one web extending between the first and second walls, the first and second walls and said at least one web defining a channel extending over at least a part of a longitudinal length of the module, the channel adapted to accommodate fill material during use, the web further comprising at least two apertures spaced apart across the web in between the first and second walls such that during use one or more transverse reinforcing members can be positioned in between reinforcing members received in the spaced apart apertures thereby limiting movement of the transverse reinforcing member there-between during use.

Providing, a web with spaced apart apertures in a configuration as described above assists in positioning reinforcing members into these apertures in a substantially horizontal orientation. Due to the above mentioned configuration, the horizontal reinforcing members are spaced away from each other and the transverse reinforcing bar received and confined in between the spaced apart horizontal members. Therefore, during pouring of the concrete, any movement of the transverse reinforcing member is confined in between the horizontally positioned reinforcing members. Furthermore, any contact in between the upright reinforcing member and the horizontally positioned reinforcing members results in dissipation of tensile stresses acting on the upright reinforcing bar to the horizontally positioned reinforcing members. As a result, bending or buckling of the upright reinforcing bar (such as an anchor bar) is avoided by the invention of the first aspect.

In an embodiment, each of the spaced apart apertures forms a part of a first row of apertures and a second row of apertures respectively such that during use, one or more reinforcing members positioned in the first row of apertures lie in a first plane that is substantially parallel to and spaced apart from a second plane of the one or more reinforcing members positioned in the one or more apertures of the second row of apertures.

In an embodiment of the present invention, said at least one web is positioned at or adjacent one lateral end of the module, said web further comprising a first connecting mechanism for inter-connecting an adjacently positioned module.

Preferably, the first connecting mechanism comprises a locking arrangement such that a locking member positioned along a vertical length of the web of a first module is configured to engage and inter-connect with a complementary groove positioned on a web of an adjacently positioned module. More preferably, the locking member and the groove are positioned substantially centrally on each of the respective webs. For example, a first module may comprise a web positioned at a lateral connecting end wherein the web comprises the locking member. A second module may be provided with a web positioned at a lateral connecting end of the second module wherein the web comprises the complementary groove. Therefore, in at least some embodiments of the invention, the first module may be interconnected with the second module by using the first connecting mechanism.

In an embodiment, the web extends over a least a portion of the length of the first wall and at least a portion of the length of the second wall along a vertical direction with reference to the module. In a preferred embodiment, the web extends over substantially the entire length of the first wall and substantially the entire length of the second wall along a vertical direction with reference to the module.

Preferably, the module comprises at least two webs extending along the first and second wall, the walls and said at least two webs defining two channels extending along the longitudinal length of the module.

The building formwork may be produced using any suitable technique. However, in a preferred embodiment of the invention, the building formwork may be produced by an extrusion moulding process.

In an embodiment, the length of the first wall is not equal to the length of the second wall.

In an embodiment, the building formwork further comprises a second connecting mechanism for inter-connecting an adjacently positioned module, the second inter-connecting mechanism being positioned at a lateral end of the first wall and/or the second wall. Preferably, the second connecting mechanism comprises a notch defined along a bottom portion of said first wall and/or second wall and provided at one lateral end of the module, the notch being adapted to inter-engage with a corresponding projection provided on a lateral end of said first and/or second wall of an adjacently positioned module, wherein during use, engagement of the notch and projection provides a means for positionally locking the module with the adjacently positioned module.

Advantageously, the apertures provided on the said at least one web are adapted for allowing flow of the fill material and wherein the apertures allow for flow of fill material from one channel to an adjacently located channel.

In an embodiment, the building formwork module further comprises a removable base member, said base member extending in a horizontal direction of the first wall and the second wall and configured for being positioned in between the first wall and the second wall, the base member comprising one or more base apertures adapted for receiving the one or more transverse reinforcing members positioned in between reinforcing members received in the spaced apart apertures.

In a second aspect, the invention provides a building formwork module for use in a modular formwork system, the module comprising a first wall spaced away from a second wall, the first and second walls being connected by at least one web located at a lateral end of the first wall and/or the second wall and extending between the first and second walls, the walls and said at least one web defining a channel extending along at least a portion of the longitudinal length of the module, which channels are able to accommodate fill material during use, wherein the horizontal length of the first wall is not equal to the horizontal length of the second wall.

Providing a building module with a first wall and a second wall with dissimilar horizontal lengths provides a significant advantage of enabling the building of curved walls using the module of the second aspect. Due to the dissimilar lengths of the walls, the lateral ends of the building module are not in parallel relationship to one another. As a result, such a module enables walls to be built in a curved manner and/or walls which are not entirely straight.

Preferably, the second aspect further comprises a first connecting mechanism for inter-connecting an adjacently positioned module, the first connecting mechanism comprising a locking arrangement such that a locking member positioned along a vertical length of the web of a first module is configured to engage and inter-connect with a complementary groove positioned on a web of an adjacently positioned module.

Additionally, the building module of the second aspect may further comprises a second connecting mechanism for inter-connecting the adjacently positioned module, the second connecting mechanism comprising a notch defined along a bottom portion and/or a top portion of said first wall and/or second wall, the notch being adapted to inter-engage with a corresponding projection provided on said first and/or second wall of an adjacently positioned module, wherein during use engagement of the notch and projection provides a means for positionally locking the module with the adjacently positioned module.

Preferably, the web further comprises one or more apertures adapted for allowing flow of the fill material therethrough and/or adapted for receiving one or more reinforcing members positioned substantially horizontally relative to the module.

In a third aspect, the invention provides a building formwork module for use in a modular formwork system, the module comprising a first wall spaced away from a second wall, the first and second walls being connected by at least one web located at a lateral end of the first wall and/or the second wall and extending between the first and second walls, the walls and said at least one web defining a channel extending along at least a portion of the longitudinal length of the module, the channels being adapted to accommodate fill material during use, wherein the module comprises a first connecting mechanism provided on the web for inter-connecting an adjacently positioned module and a second connecting mechanism provided on the first wall and the second wall for inter-connecting an adjacently positioned module, wherein during use the first connecting mechanism and the second mechanism provide a sealing means to confine the fill material within an internal space defined by the first wall, the second wall and the webs of connected modules.

The connecting mechanism of the third aspect assists in providing a seal in between the inter-connected modules. The first connecting mechanism provided on the web assists in securing a sealed connection in between the connected webs of adjacently positioned modules and prevents any fluidised concrete from seeping out from the channels of the connected modules. The second connecting mechanism prevents positional movement of the inter-connected modules, thereby ensuring that the seal provided by the first connected mechanism is not in any way compromised due to undesirable positional movement of the connected modules.

Preferably, the first connecting mechanism comprises a locking arrangement such that a locking member positioned along a vertical length of the web of a first module is configured to engage and inter-connect with a complementary groove positioned on a web of an adjacently positioned module.

Preferably, the second connecting mechanism further comprises a notch defined along a bottom portion and/or a top portion of said first wall and/or second wall adapted to inter-engage with a corresponding projection provided on said first and/or second wall of an adjacently positioned module, wherein during use engagement of the notch and projection provides a means for positionally locking the module with the adjacently positioned module.

In yet another aspect, there is provided a building formwork capping module for capping a lateral end of the module as described herein, the capping module comprising an outer wall and adapted for engaging and inter-connecting with the first connecting mechanism and the second connecting mechanism provided on an the lateral end of the module thereby capping a lateral end of the module.

In yet another aspect, the invention provides a modular formwork system comprising a plurality of building formwork modules in accordance with one or more of the previously described aspects. The system may also comprise reinforcing members as described herein.

The formwork panel may be of any suitable size, shape or configuration. However, it is envisaged that the side walls may at least partially define a cavity therebetween into which concrete or similar material (hereinafter referred to for simplicity as "concrete") may be poured.

The first and second walls may extend in any suitable direction relative to one another and may define any suitable shape therebetween when viewed from above. Thus, in some embodiments, the pair of side walls may also taper towards each other at a first end of the formwork panel and may diverge away from one another at an opposed second end of the formwork panel. Similarly, the side walls may be curved, or have two or more sections disposed at angles to one another. It is envisaged, therefore, that the pair of side walls may define, for instance, a triangular shaped cavity, a diamond shaped cavity, a circular cavity, an oval cavity and so on.

In other embodiments, the first and second walls may extend substantially parallel to one another and the webs may also extend substantially parallel to one another such that the walls and the one or more webs together define a substantially square or rectangular cavity into which concrete may be poured.

The side walls may be further reinforced by way of providing vertically extending ribs.

As previously stated, the formwork panel may comprise a plurality of ribs extending between the side walls. In a preferred embodiment of the invention, the plurality of ribs may include an end rib extending between the side walls at opposed ends of the formwork panel, and one or more intermediate ribs extending between the side walls of the formwork panel at points between the opposed ends of the formwork panel.

The side walls may be of any suitable length and height, and it will be understood that the formwork panel may be fabricated to any suitable specifications in terms of its length and height. The length and height of the formwork panel may be determined by the application and/or location in which the formwork panel is to be used. In some embodiments of the invention, the formwork panel may be custom fabricated for use in a specific location. More preferably, however, the formwork panel may be fabricated in a plurality of standard sizes (i.e. formwork panels of differing length and width). Preferably, the first and second walls are substantially the same height as one another, although the walls may be provided with differing lengths as previously described, for instance, if a non-square or non-rectangular formwork panel is required.

The webs may be of any suitable height and length, and it is envisaged that the length of the webs may be varied depending on the desired volume of the cavity to be filled with concrete. By varying the length of the webs, the distance between the side walls may be varied, thereby changing the volume of the cavity defined by the side walls and the end walls. Preferably, the height of the webs is substantially the same as the height of the first and second walls. In embodiments of the invention in which the formwork panel defined a substantially square or rectangular cavity, it is envisaged that each of the webs may be substantially the same length.

As previously stated, each of the webs is provided with a plurality of apertures therethrough. The apertures may be of any suitable size or shape and may be located at any suitable position on the ribs. Preferably, however, the apertures may be of sufficient size to allow one or more members to pass therethrough and also allow passage of fluidised concrete therethrough. Any suitable members may be passed through the apertures, such as reinforcing members (e.g. reinforcing rods, such as steel reinforcement rods). Therefore, during use, the apertures may allow passage of reinforcing members and also allow transfer of fluidised concrete from one channel to another channel.

In all aspects of the invention, the fill material may be of any suitable form. For instance, the fill material may comprise particulate material, such as gravel, sand, soil or the like. Alternatively, the fill material may comprise a settable, curable or hardenable composition. In a particular embodiment of the invention, the fill material may comprise cement, concrete or the like. It is envisaged that, in this embodiment of the invention, the cement or concrete may be allowed to solidify and/or harden within the formwork module to form a solid or substantially solid substance.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
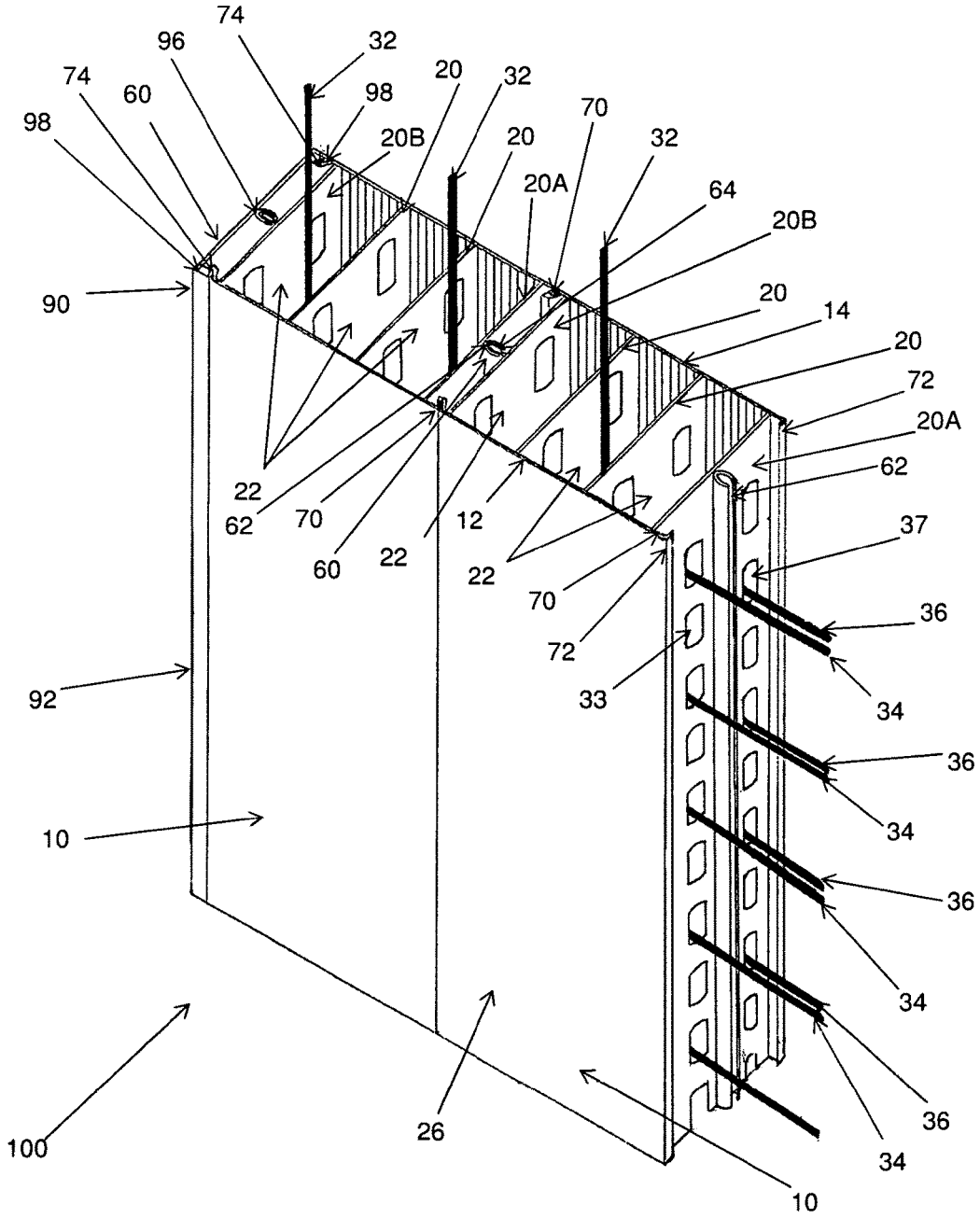
FIG. 1 is a perspective view of a modular formwork system comprising formwork modules according to a first embodiment.

A first preferred embodiment of the present invention is shown is described with reference to FIGS. 1 to 5 a modular formwork system 100 having a plurality of formwork modules 10 is shown. The formwork system 10 may be used for construction of both internal and external walls for residential houses. The system could also be employed in other related applications.

Each of the building formwork modules 10 comprises a lightweight plastics moulded building module, or unit, having a first wall and a second wall in the form of a first face 12 and an opposite second face 14. Webs 20 are arranged so as to extend between the first and second faces 12 and 14 such that the faces 12, 14 and each of the webs 20 define channels 22 that extend along the longitudinal length of the module 10. In the preferred embodiment webs 20A and 20B form lateral sides of each of the modules 10. The channels 22 are able to accommodate wall forming fill material such as super-fluidised concrete in that the concrete is able to be poured into the channels 22 and settle therein and subsequently harden upon curing. The concrete can be varied in its specification according to whether strength, flow or insulating qualities are required. The use of aerated concrete is also envisaged in circumstances requiring a high level of insulation. As will be evident from further discussions in foregoing sections, the invention is no way limited to the number of webs 20 or the positioning of the webs along the horizontal length of the module.

Provision of a plurality of webs 20 in the module 10 provides the module 10 with a rigidity that maintains a relatively flat outer surface 26 on the first side 12 of the module 10, against what would be the pressure applied by the super-fluidised concrete as it solidifies within the channels 22. By having module 12 formed from plastics material such that the web 20 provides channels of sufficient rigidity and the embodiment is able to provide a readily handled building unit that facilitates the construction of a variety of walls according to a wide variety of floor plan characteristics, that are commonly used in and exhibited by residential buildings.

Importantly, the provision of a flat outer surface 26 on each of the modules 12, once the concrete poured into the channels has hardened, ensures that the wall formed can have sheeting such as wall paneling or tiles readily applied to the flat outer surface. The wall formed on such a flat outer surface is of a high quality finish and is only offset from vertical by the smallest of margins and can thus be constructed to the correct horizontal alignment.

Figure 2:
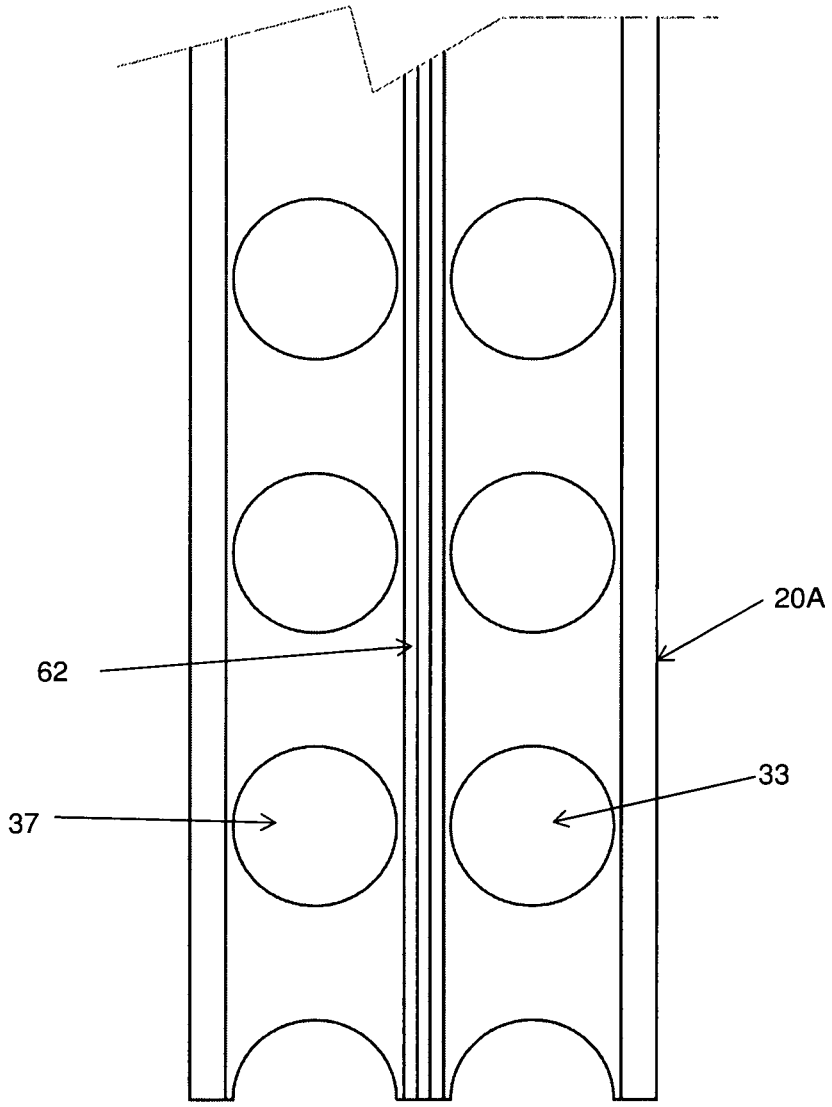
FIG. 2 is a front view of a web of a formwork module according to a first embodiment.
Figure 3:
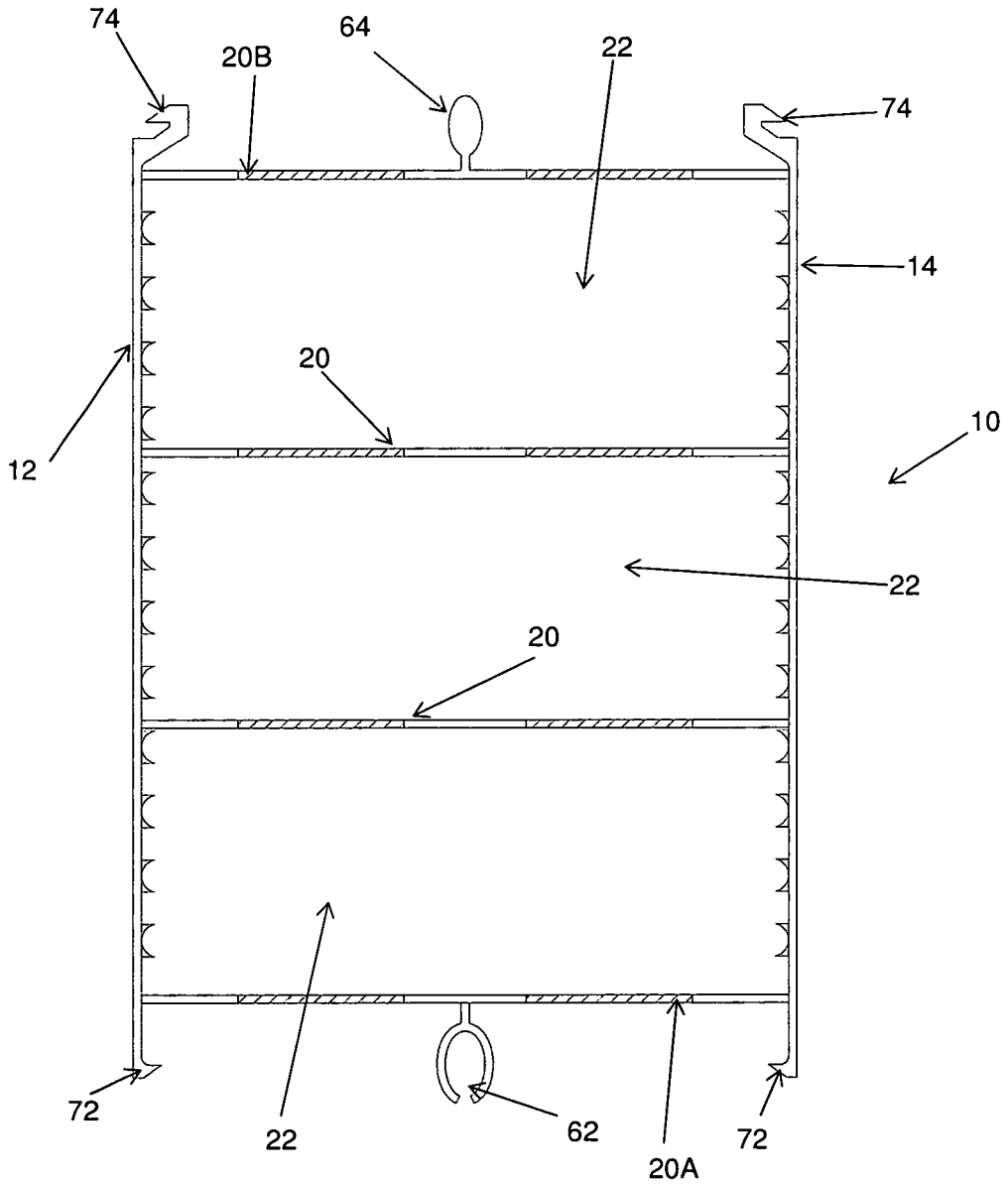
FIG. 3 is a top view of a formwork module according to a first embodiment.
Figure 4:
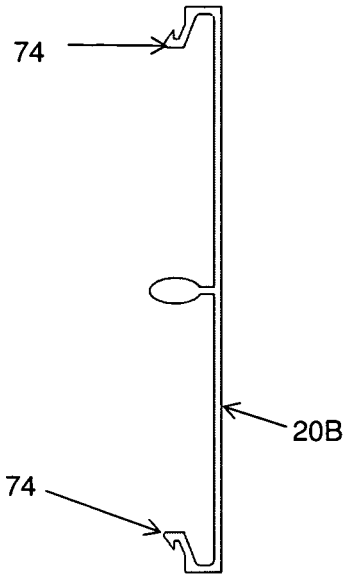
FIG. 4 is a top view of a first lateral end of a formwork module according to a first embodiment.
Figure 5:
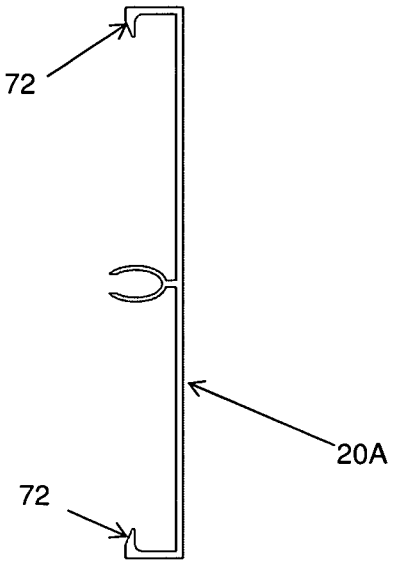
FIG. 5 is a top view of a second lateral end of a formwork module according to a first embodiment.
Figure 8:
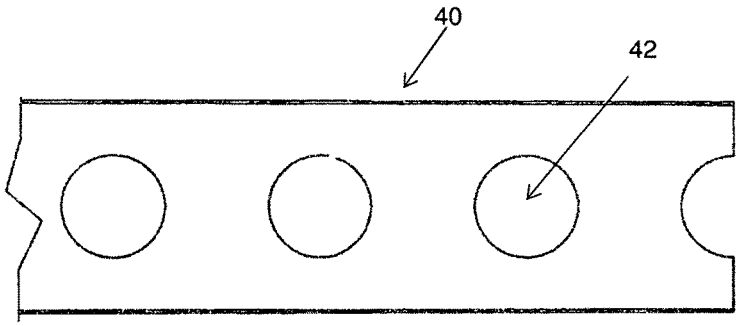
FIG. 8 is a top view of a base member adapted for use with the module of the first embodiment.

Anchor bars 32 are inserted and/or positioned transversely through channels 22 and fixed at their ends and anchored to the supporting surface typically a concrete slab (not shown). Advantageously, a base member in the form of an anchor-rod fitting attachment 40 (as shown in FIG. 8) is provided for positioning the anchor rods 32. The anchor rod fitting attachment 40 is provided with anchor rod receiving holes 42 that enables the passage of the anchor rods 32 therethrough. During use, the anchor rod fitting attachment 40 is positioned adjacent the supporting surface. The two ends of the anchor bars 32 may also be provided with threads onto which threaded nuts may optionally be threaded as anchor fastenings. During the pouring of concrete into the channels 22, significantly high values of pressure act along the length of the anchor bars 32 resulting in tensile stress along the anchor bar 32. In prior art modular forming systems such movement of anchor bars can significantly result in reduction of structural integrity of the building. However, the present embodiment alleviates this problem by providing spaced apart horizontal reinforcing members 34 and 36 that are positioned for limiting the movement of the anchor bar 32 such that the horizontal reinforcing bars are positioned in between the first face 12 and the second face 14 such that movement of the anchor bar 32 is restricted in between the horizontally positioned reinforcing bars 34 and 36. The pressure exerted during concrete-casting by the liquid concrete results in slight movement of the anchor bars 32. However, due to the positioning of the horizontal reinforcing bars 34 and 36, any contact between the anchor bars 32 and the reinforcing bars 32 or 36 results in the forces being re-directed to the horizontal bars 34 or 36 and gets transmitted along the length of the modules. Thus, the reinforcing horizontal bars 34 and 36 are able to absorb the compressive forces that occur during concrete casting and mounting of the anchor bars 32. Referring to FIGS. 1 and 2 in particular the horizontal reinforcing bars 34 and 36 are positioned by way of being received in apertures provided on each web 20. Specifically, each web 20 is provided with a first row of apertures 33 positioned in close proximity to the first face 12. The first row 33 of apertures may also be classified as the first type of apertures 33. Each web 20 is also provided with a second row of apertures 37 positioned in close proximity to the second face 14 and these apertures may be classified as the second type of apertures 37. Each of the first type of apertures 33 in each web 20 are spaced apart from each other across the web 20 in between the first face 12 and the second face 14 and are aligned with a corresponding aperture on an adjacent web 20 such that during use one or more transverse anchor bars can be positioned in between reinforcing bars 34, 36 received in the spaced apart apertures of the first row and the second row. Positioning the reinforcing bars 34 into the first row of apertures 33 in each of the webs 20 results in these bars 34 substantially being aligned and lying in a first imaginary plane that is substantially parallel to and spaced away from a second imaginary plane of the reinforcing bars 36 positioned in the second type of apertures 37. As a result of such a configuration of the webs 20, reinforcing bars 34 and 36 can extend throughout the length of each module 10 and assist in dissipating the excessive compressive forces transferred to these reinforcing bars 34 and 36 by the anchor bars 32. The positioning of the reinforcing bars 34 and 36 also limits the movement of the anchor bar in an internal space defined by the reinforcing bars 34 and 36 held in the web apertures 33 and 37 respectively.

The web apertures also provide flow holes such that fluidised concrete is able to flow through the web apertures 33, 37 in between channels 22. Therefore, web apertures are sized to allow flow of concrete even when the reinforcing members 34, 36 are passing through these apertures. As noted earlier, web apertures 33, 37 in the lateral webs 20A and 20B are aligned with the apertures 33, 37 on the intermediately positioned webs 20. This configuration also allows fluidised concrete to flow from one module 10 to an adjacently positioned module 10 as shown particularly in FIG. 1 thereby forming an inter-connected structure. The present embodiment is further provided with connecting mechanisms for inter-connecting adjacently positioned modules 10 and also preventing any leaking of fluidised concrete out of the modules 10. Specifically, there are two connecting mechanisms that have been provided in the present embodiment for achieving inter-engagement of adjacent modules including flow of fluidised concrete in between adjacent and interconnected modules.

It will be noted that, in the embodiment of the invention shown in FIG. 2, the web apertures 33, 37 are substantially circular.

Figure 6:
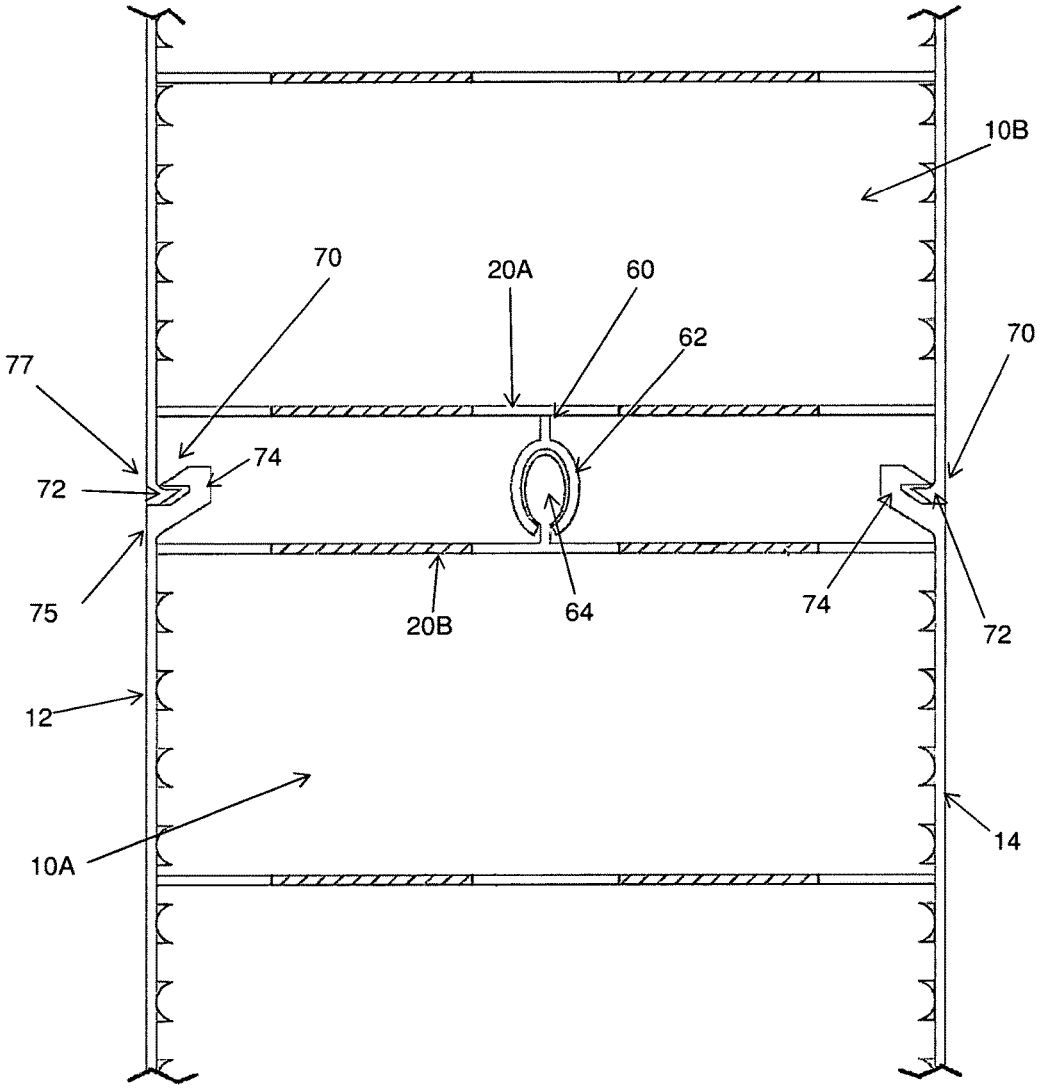
FIG. 6 is an enlarged top view of a formwork module used in a modular formwork system according to a first embodiment.

Referring particularly to FIG. 6, a first connecting mechanism 60 is provided on the web 20. The connecting mechanism 60 comprises a centrally positioned U-shaped groove 62 extending vertically along the length of the lateral web 20A. The groove 62 is configured for receiving a locking member in the form of an elongate tongue 64 that is centrally positioned on a web 20 and extends vertically along a length of the opposite lateral web 20B. During a typical modular installation as shown in FIG. 1, a lateral side 20A of one module is positioned adjacent to the opposed lateral side 20B of another adjacent module 10. Due to the provision of the U-shaped groove 62 on 20A of the first module, the tongue 64 provided on the lateral web 20B of the adjacent module may be received by the U-shaped groove thereby inter-connecting the two adjacent modules by engaging the tongue 64 with the groove 62. As a result of this inter-engagement, the lateral web 20A of the first module 10 is positioned in substantial alignment and flush against lateral web 20B of the adjacent module resulting in a tight seal in between adjacently positioned connected modules 10. Providing such a tight seal is highly advantageous because it prevents any fluidised concrete material from seeping out of the modules especially out of the lateral webs 20A and/or 20B and instead assist in transfer of concrete from one module 10 to another adjacently positioned module 10. The provision of such a feature is particularly advantageous in that it does not require each module 10 to be supplied with concrete separately and instead enables operators to fill up concrete in only one of the modules and rely on the transfer of concrete from one inter-connected module 10 to another inter-connected module 10.

The modular formwork system 100 is further provided with a second connecting mechanism 70 that is provided on the first face 12 and the second face 14. In some of the prior art modular formwork systems, introducing fluidised concrete into an internal space of formwork modules often results in high levels of vibration and can often result in displacing modules arranged adjacent to one another. The present embodiment, addressed this problem in the prior art by way of providing the second connecting mechanism 70 that assists in locking the position of a module relative to another adjacent module 10. Notches 74 are provided along a bottom portion and a top portion on a first lateral side 75 of the first face 12 and the second face 14. On a second lateral side 77 of the first face 12 and the second face 14 projections 72 with complementary configuration are provided. Once again as explained in earlier sections, positioning a module 10 with the first lateral side 75 of a first module 10A lying adjacent to the second lateral side 77 of an adjacently positioned module 10B results in the projections 72 engaging and locking into notches 74 of the adjacent module thereby positionally locking the adjacently placed module relative to each other.

A capping module 90 for capping a lateral end of the module 10 is also provided for positioning at a free end of the wall being built by the formwork system. The capping module 90 comprises an outer wall 92. On an inner wall portion, the module comprises groove 96 and projections 98 adapted for engaging with elongate tongue 62 and notches 74 respectively. The wall 92 and the web 20B also provide a channel for receiving fluidized concrete. Therefore, the capping module assists in finishing a free end of a wall being built by the modular formwork system 100. It is further envisaged that the configuration of the capping module 90 is no way limited by the provision of a groove 96 and projections 98. For example, further embodiments of the capping module may be provided with an elongate tongue running along the inner wall portion of the wall 92 and may also be provided with notches. Provision of a tongue and notches on the wall 92 in capping the other lateral end (20B) of the module 10.

Figure 7:
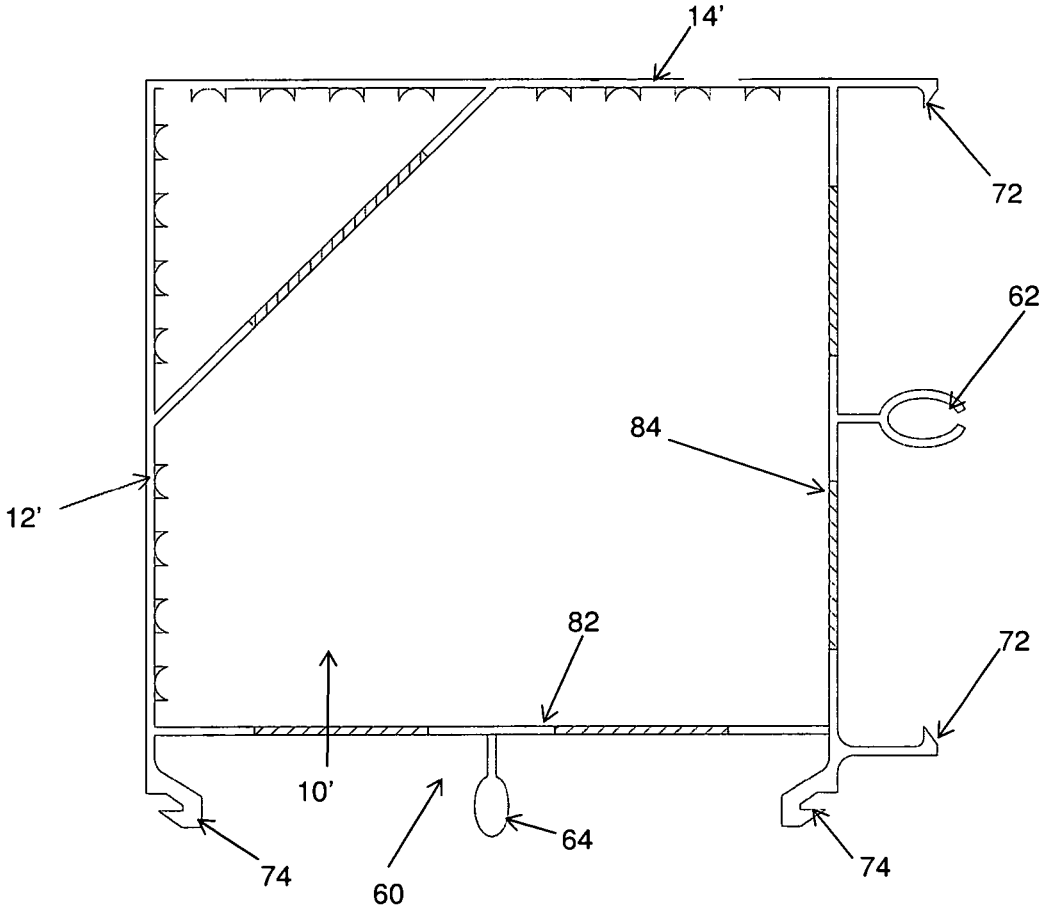
FIG. 7 is a top view of a second embodiment of the formwork module in accordance with the present invention.

Referring to FIG. 7, an alternative embodiment of a module 10' for use with the modular formwork system 100 is shown. Module 10' is particularly configured for use in a building system in which concrete walls need to be erected in perpendicular relationship to each other. Like reference numerals refer to features which have been previously described in the specification. It is to be noted that in module 10, the connecting mechanisms namely 60 and 70 work in the same manner as discussed in preceding sections. In a typical operation for 'positioning modules 10 adjacent to module 10', the second side 77 of a first module 10 would need to be positioned adjacent to a first connecting face 82 of module 10'. This would result in tongue 64 provided on the connecting face 82 to inter-engage with the groove 62 provided on the web 20A of the adjacent module 10. Similarly, positioning another module 10 with its first lateral side 75 being adjacent to the connecting face 84 of the module 10' would result in engagement of the second module 10 with the module 10'. Therefore, by using the module 10', building modules 10 can be arranged and inter-connected in perpendicular relationship to each other.

Figure 9:
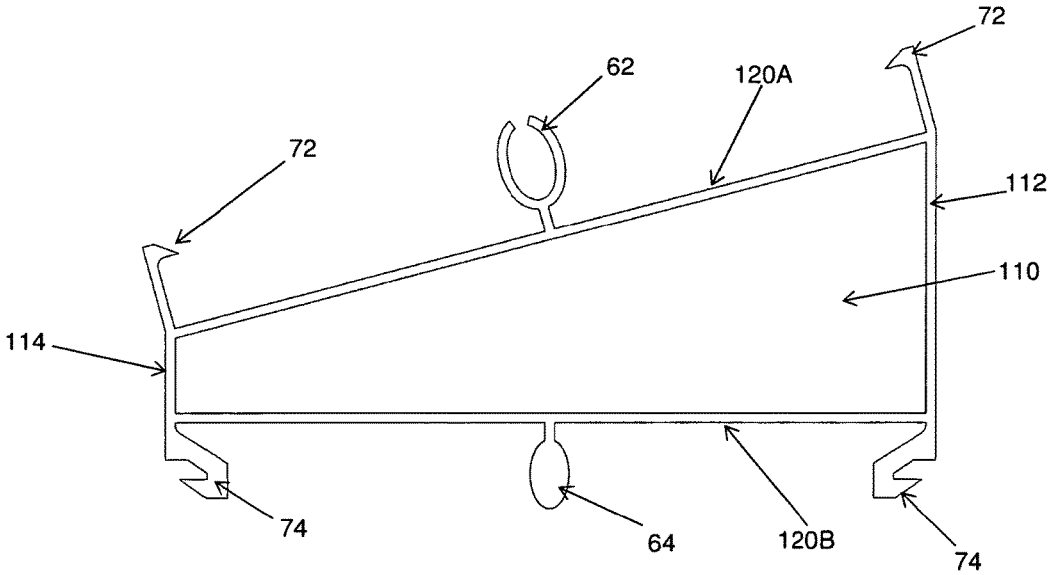
FIG. 9 is a top view of a third embodiment of a formwork module.
Figure 10:
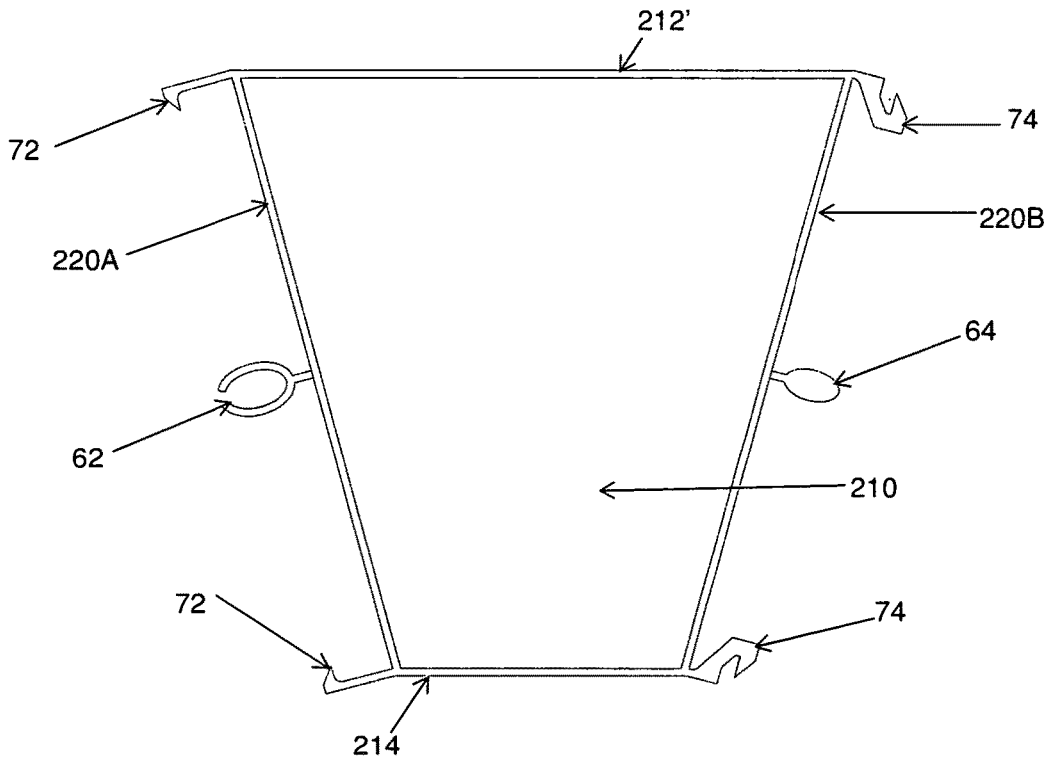
FIG. 10 is a top view of a fourth embodiment of a formwork module.
Figure 11:
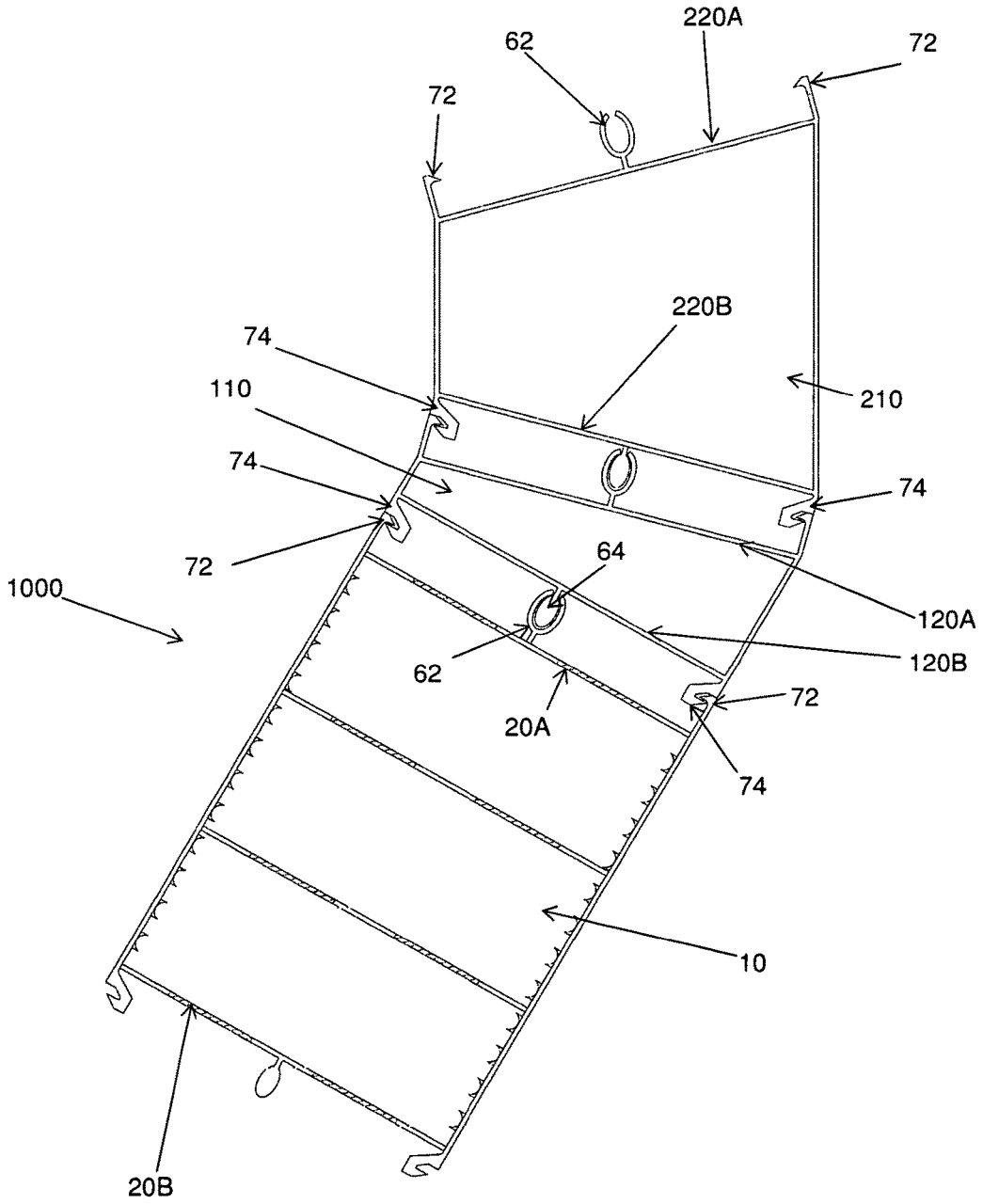
FIG. 11 is a top view of another modular formwork system comprising formwork modules of the third and fourth embodiment.

Referring to FIGS. 9 to 11, another embodiment of the present invention is shown. Like reference numerals represent like features that have been previously discussed in preceding sections. One of the significant disadvantages of previously known formwork systems is that these prior art systems are directed to building walls along a straight and such prior art systems do not provide modular formwork for building curved walls. The present applicant is not aware of any known modular formwork building systems that enable the continuous building of walls along a curve or along several angles. The module embodiment described herein alleviates this problem by providing a module 110 comprising a first face 112 spaced away from a second face 114, the first and second faces 112, 114 being connected by webs 120 located at a first lateral end of the first face 112 and the second face 114. The webs 120 and the faces 112, 114 define a channel that receives fluidized concrete. As evident from FIG. 9, the first face 112 is parallel to the second face 114. However, the horizontal length of the first face 112 is greater than the horizontal length of the second face 114. The difference in the horizontal lengths of the faces of the module 110 is highly advantageous because it enables in building a curved wall as will be explained in greater detail in the foregoing sections. The module 110 is particularly but not exclusively useful as a starting module or an initial module for building a curved wall.

Another embodiment in the form of a module 210 that suitable for building curved walls is shown in FIG. 10. Once again like reference numerals represent like features as discussed in preceding sections. The module 210 comprises a first face 212 spaced away from a second face 214, the first and second faces 212, 214 being connected by webs 220 located at a first lateral end of the first face 212 and the second face 214. The webs 220 and the faces 212, 214 define a channel that receives the fluidized concrete. As evident from FIG. 10, the first face 212 is parallel to the second face 214. However, the horizontal length of the first face 212 is greater than the horizontal length of the second face 214. The difference in the horizontal lengths of the faces of the module 210 is also highly advantageous because it enables in building a curved wall as will be explained in greater detail in the foregoing sections. The module 110 is particularly but not exclusively useful as a starting module or an initial module for building a curved wall.

Referring to FIG. 11, modular formwork system 1000 illustrates an in-use configuration of the modules 110 and 210 in conjunction with module 10 (as discussed in previous sections) to form a curved wall. As illustrated in FIGS. 9-11, the difference in the horizontal length of the opposed faces of the modules 110 and 210 enable these modules to be used for building a curved wall. As previously discussed, the connecting mechanisms 60 and 70 positioned at each lateral side of the modules 10, 110 and 210 assists in connecting these modules continuously in a manner to allow flow of concrete from one module to another module.

A skilled person would readily appreciate, that the embodiments described herein are non-limiting and one or more features described in one embodiment may be readily adopted in combination with features of another embodiment. For example, the features of apertures provided in the web 20 as shown in the embodiments of FIGS. 1-6 may be readily adopted in the embodiment described in FIGS. 9-11.

Figure 12:
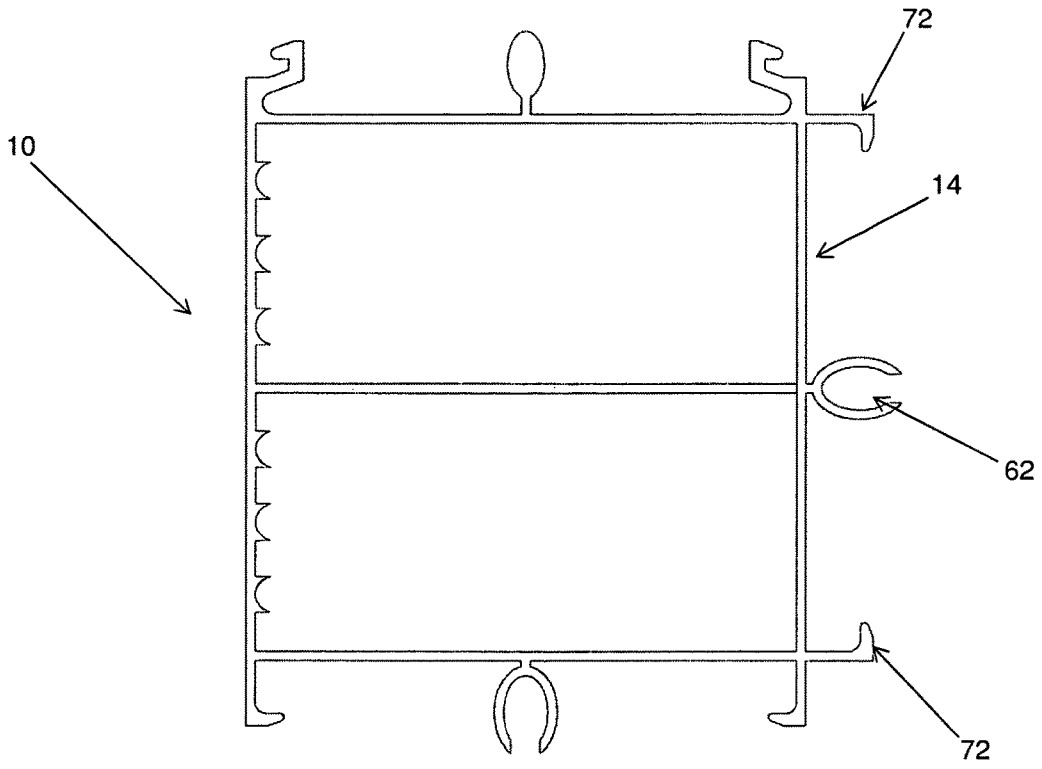
FIG. 12 is a top view of a formwork module according to an alternative embodiment.

In FIG. 12 there is shown a top view of a formwork module 10 according to an alternative embodiment of the invention. The formwork module 10 of FIG. 12 is similar to that shown in FIG. 3, with the exception that an additional U-shaped groove 62 is provided on the second face 14 of the formwork module 10 to allow the formwork module 10 to be connected to an adjacent formwork module (not shown). In addition, projections 72 extend from the second face 14 for connection to an adjacent module.

Figure 13:
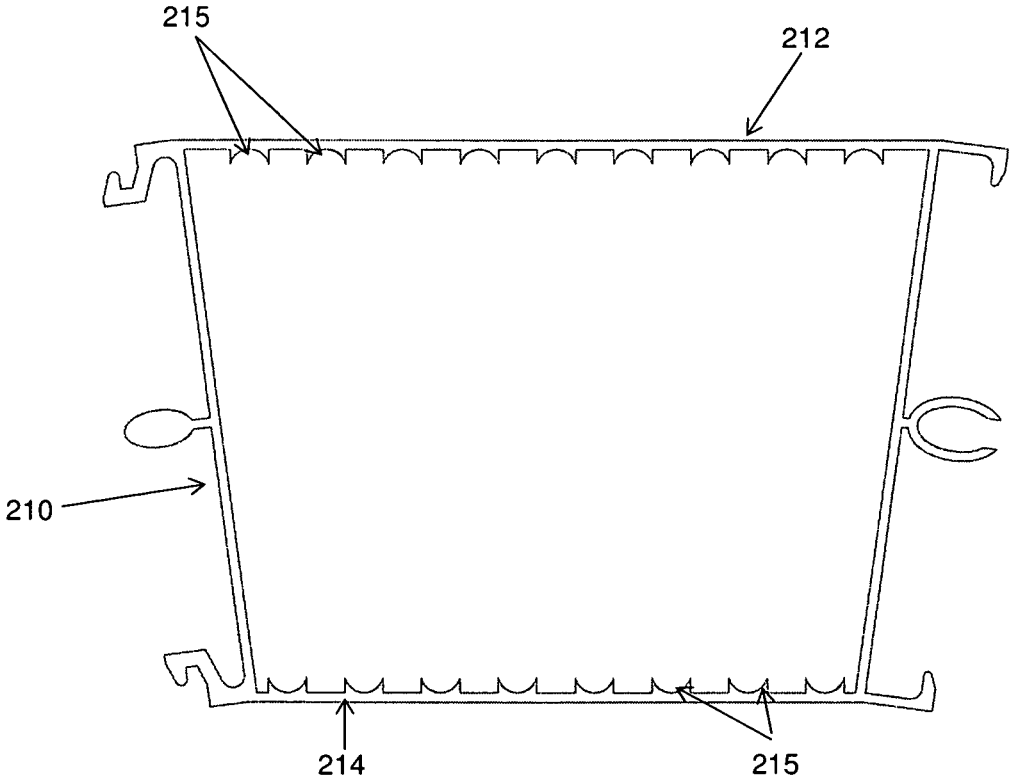
FIG. 13 is a top view of a formwork module according to an alternative embodiment.

In FIG. 13 there is shown a top view of a formwork module 210 according to an alternative embodiment of the invention. The formwork module 210 shown in FIG. 13 is similar to the shown in FIG. 10 with the exception that the first and second faces 212, 214 are longer, meaning that the formwork module 210 is wider than that shown in FIG. 13.

In addition, the formwork module 210 of FIG. 13 includes a plurality of reinforcing ribs 215 located on inner surfaces of the first and second faces 212, 214.

Figure 14:
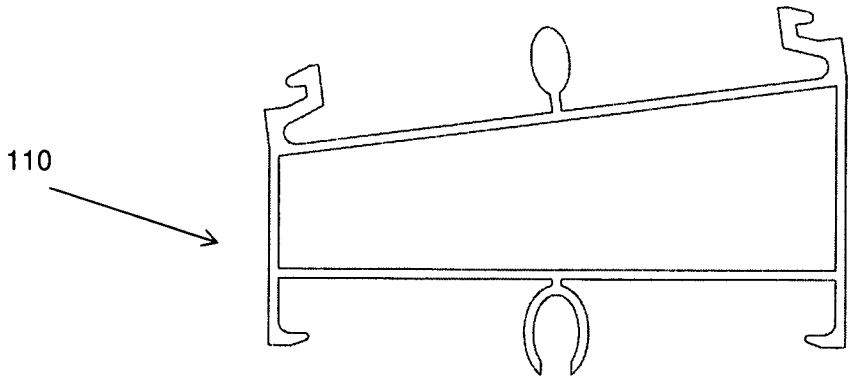
FIGS. 14 and 15 are top views of a formwork module according to an alternative embodiment.
Figure 15:
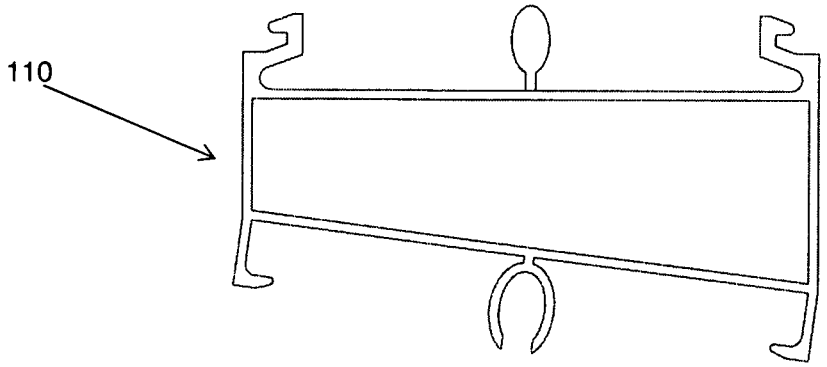

FIGS. 14 and 15 are top views of formwork modules 110 according to an alternative embodiment of the invention. The formwork modules 110 illustrated in FIGS. 14 and 15 are variations of that illustrated in FIG. 9.

Figure 16:
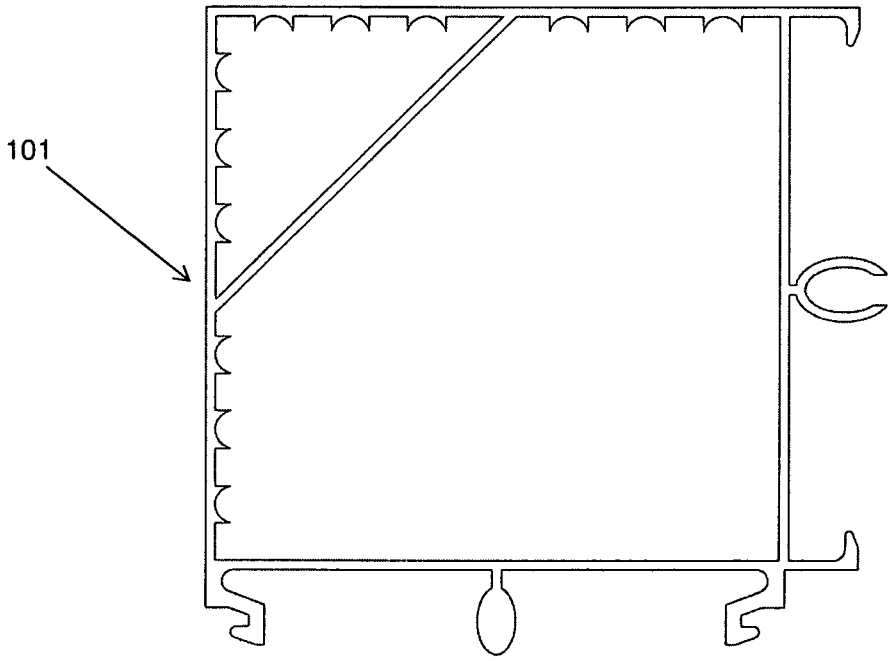
FIG. 16 is a top view of a base member according to an alternative embodiment.

FIG. 16 is a top view of a base member 101 according to an alternative embodiment of the invention. The base member 101 illustrated in FIG. 16 is a variation of that illustrated in FIG. 7.

Thus it will be seen that embodiments of the invention can provide for a flexible formwork system comprising a number of rigid plastic concrete modules that abut against each other and arranged to form straight walls or curved walls. Providing continuously connected modules as described herein allows transfer of concrete in between connected modules and accommodating anchor bars and reinforcing bars allows for the formation of and interlocked concrete core. By virtue of the plastic formwork covering the concrete core, moisture penetration into the concrete, which is in comparison quite porous, is also significantly limited. The modules are relatively light weight, are easily handled on site, and provide for a relatively flat exterior surface. The system allows for rapid wall construction obviating the tedious task of brick-laying. Accurate vertical surfaces and curved surfaces are produced with the use of the modules and formwork system and flexibility is achieved so that walls can be constructed to a number of conventional wall plans.

As for noise, the walls built by the modular formwork system of the present invention are denser then hollow core brick and substantially reduce airborne sound propagation. Any voids created in completed wall will absorb impact noise. Penetration of water by osmosis or capillary action is reduced in comparison to penetration that occurs with a layered construction of brickwork. In terms of the alignment, the embodiments described provide for good verticality and horizontal alignment.

Furthermore the interlocked concrete core provides the wall with a high thermal mass which in combination with wall cladding provides for relatively superior insulation. Thus the energy efficiency of a residential house constructed according to the embodiments described is expected to be considerably greater than conventional residential houses.

The preferred embodiment of the module described herein has been produced by an extrusion moulding process. The modules have a wall thickness of approximately 2.5 mm and comprise extruded Poly Vinyl Chloride (PVC).

Throughout the specification, the terms vertical, vertically, upright, horizontal, horizontally and other terminology in relation to orientation of one or more features described herein generally relate to the module's orientation in an in-use configuration on a supporting surface such as a concrete slab.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A building formwork module for use in a modular formwork system, the building formwork module comprising a first wall spaced away from a second wall, the first and second walls being connected by at least a pair of webs extending between the first and second walls, the first and second walls and the at least a pair of webs defining a channel extending over at least a part of a longitudinal length of the building formwork module, the channel adapted to accommodate fill material during use, each of the at least a pair of webs further comprising at least two apertures spaced apart across the web in between the first and second walls such that during use one or more transverse reinforcing members can be positioned in between reinforcing members received in the spaced apart apertures thereby limiting movement of the transverse reinforcing member there-between during use, wherein a first web of the at least a pair of webs is positioned spaced inwardly from a first lateral end of the building formwork module, and a second web of the at least a pair of webs is positioned spaced inwardly from an opposed second lateral end of the building formwork module, the first web further comprising a first connecting mechanism for inter-connecting an adjacently positioned building formwork module, and wherein the first connecting mechanism comprises a locking arrangement such that a locking member positioned along a vertical length of the first web of the building formwork module and extending outwardly therefrom towards the adjacently positioned building formwork module is configured to engage and interconnect with a complementary groove positioned on a web of the adjacently positioned building formwork module, the locking member and the complementary groove being positioned substantially centrally on each of the first web and the web of the adjacently positioned building formwork module, respectively, and wherein the first and second walls of the building formwork module and the adjacently positioned building formwork module, the first web of the building formwork module in which the locking member is positioned, and the web of the adjacently positioned building formwork module on which the complementary groove is positioned together define an internal space adapted to accommodate the fill material during use, the building formwork module further comprising a second connecting mechanism for inter-connecting the adjacently positioned building formwork module and/or a second adjacently positioned building formwork module, the second connecting mechanism being positioned at a lateral end of the first wall and/or the second wall, the second connecting mechanism comprising a notch defined along the first wall and/or second wall adapted to inter-engage with a corresponding projection provided on a wall of the adjacently positioned building formwork and/or the second adjacently positioned building formwork module, wherein during use engagement of the notch and projection are configured to positionally lock the building formwork module with the adjacently positioned building formwork module and/or the second adjacently positioned building formwork module.

2. A building formwork in accordance with claim 1, wherein each of the spaced apart apertures forms a part of a first row of apertures and a second row of apertures respectively such that during use, one or more reinforcing members positioned in the first row of apertures lie in a first plane that is substantially parallel to and spaced apart from a second plane of the one or more reinforcing members positioned in the one or more apertures of the second row of apertures.

3. A building formwork module in accordance with claim 1, wherein at least one of the first web or the second web extends along a substantial length of the first wall and along a substantial length of the second wall along a vertical direction with reference to the building formwork module.

4. A building formwork module in accordance with claim 1, wherein the length of the first wall is not equal to the length of the second wall.

5. A building formwork module in accordance with claim 1, wherein the spaced apart apertures are adapted for allowing flow of the fill material.

6. A building formwork module in accordance with claim 5, wherein the spaced apart apertures allow for flow of the fill material from one channel to an adjacently located channel and/or to the internal space.

7. A building formwork module in accordance with claim 1, further comprising a removable base member, the removable base member extending in a horizontal direction of the first wall and the second wall and configured for being positioned in between the first wall and the second wall, the removable base member comprising one or more base apertures adapted for receiving the one or more transverse reinforcing members positioned in between the reinforcing members received in the spaced apart apertures.

8. A modular formwork system comprising a plurality of building formwork modules in accordance with claim 1.

9. A building formwork module for use in a modular formwork system, the building formwork module comprising a first wall spaced away from a second wall, the first and second walls being connected by at least a pair of webs, wherein a first web of the at least a pair of webs is positioned spaced inwardly from a first lateral end of the building formwork module and a second web of the at least a pair of webs is positioned spaced inwardly from an opposed second lateral end of the building formwork module, the first web and the second web extending between the first and second walls, the first and second walls and the at least a pair of webs defining a channel extending along at least a portion of a longitudinal length of the building formwork module, wherein the channel is adapted to accommodate fill material during use, wherein the length of the first wall is not equal to the length of the second wall, the first web further comprising a first connecting mechanism for inter-connecting an adjacently positioned building formwork module, and wherein the first connecting mechanism comprises a locking arrangement such that a locking member positioned along a vertical length of the first web of the building formwork module and extending outwardly therefrom towards the adjacently positioned building formwork module is configured to engage and interconnect with a complementary groove positioned on a web of the adjacently positioned building formwork module, the locking member and the complementary groove being positioned substantially centrally on each of the first web and the web of the adjacently positioned building formwork module, respectively, and wherein the first and second walls of the building formwork module and the adjacently positioned building formwork module, the first web of the building formwork module in which the locking member is positioned, and the web of the adjacently positioned building formwork module on which the complementary groove is positioned together define an internal space adapted to accommodate the fill material during use, the building formwork module further comprising a second connecting mechanism for inter-connecting the adjacently positioned building formwork module and/or a second adjacently positioned building formwork module, the second connecting mechanism comprising a notch defined along the first wall and/or second wall, the notch being adapted to inter-engage with a corresponding projection provided on a wall of the adjacently positioned building formwork module or the second adjacently positioned building formwork, wherein during use engagement of the notch and projection are configured to positionally lock the building formwork module with the adjacently positioned building formwork module and/or the second adjacently positioned building formwork module.

10. A building formwork module in accordance with claim 9, wherein the first web and/or the second web further comprises one or more apertures adapted for allowing flow of the fill material there-through and/or adapted for receiving one or more reinforcing members positioned substantially horizontally relative to the building formwork module.

11. A building formwork module for use in a modular formwork system, the building formwork module comprising a first wall spaced away from a second wall, the first and second walls being connected by at least a pair of webs, wherein a first web of the at least a pair of webs is positioned spaced inwardly from a first lateral end of the building formwork module and a second web of the at least a pair of webs is positioned spaced inwardly from an opposed second lateral end of the building formwork module, the at least a pair of webs extending between the first and second walls, the first and second walls and the at least a pair of webs defining a channel extending along at least a portion of a longitudinal length of the building formwork module, the channel being adapted to accommodate fill material during use, wherein the building formwork module comprises a first connecting mechanism provided on the first web for inter-connecting an adjacently positioned building formwork module and a second connecting mechanism provided on the first wall and the second wall for inter-connecting the adjacently positioned building formwork module, wherein during use the first connecting mechanism and the second connecting mechanism are configured to create a seal to confine the fill material within an internal space defined by the first wall, the second wall and the webs of connected building formwork modules, and wherein the first connecting mechanism comprises a locking arrangement such that a locking member positioned along a vertical length of the first web of the building formwork module and extending outwardly therefrom towards the adjacently positioned building formwork module is configured to engage and interconnect with a complementary groove positioned on a web of the adjacently positioned building formwork module, the locking member and the complementary groove being positioned substantially centrally on each of the first web and the web of the adjacently positioned building formwork module, respectively, wherein the second connecting mechanism comprises a notch defined along the first wall and/or second wall adapted to inter-engage with a corresponding projection provided on a first and/or second wall of the adjacently positioned building formwork module and/or a second adjacently positioned building formwork module, wherein during use engagement of the notch and projection are configured to positionally lock the building formwork module with the adjacently positioned building formwork module and/or the second adjacently positioned building formwork module.

12. A building formwork capping module for capping a lateral end of the building formwork module in accordance with claim 11, the building formwork capping module comprising an outer wall and adapted for engaging and inter-connecting with the first connecting mechanism and the second connecting mechanism provided on the lateral end of the building formwork module thereby capping a lateral end of the building formwork module.

* * * * *